United States Patent [19]

Savage

[11] Patent Number: 4,672,692

[45] Date of Patent: Jun. 16, 1987

[54] BATH WITH AIR JET

[76] Inventor: Nigel C. Savage, 4, Shelley Gardens, Hinckley, Leicestershire, LE10 1TA, England

[21] Appl. No.: 638,550

[22] Filed: Mar. 11, 1986

[51] Int. Cl.[4] ..... B01F 3/04; A47K 3/00

[52] U.S. Cl. ..... 4/543; 261/26; 261/30; 261/122; 261/77

[58] Field of Search ..... 261/DIG. 88, 26, 30, 261/122; 4/542, 543

[56] References Cited

U.S. PATENT DOCUMENTS 2,636,473 4/1953 Schwartz et al. ..... 261/DIG. 88
4,166,296 9/1979 Darrah et al. ..... 4/543

FOREIGN PATENT DOCUMENTS 2026317 2/1980 United Kingdom .
2107180 4/1983 United Kingdom .
2163952 3/1986 United Kingdom .

*Primary Examiner*—Tim Miles
*Attorney, Agent, or Firm*—Lowe Price LeBlanc Becker & Shur

[57] ABSTRACT

A bath 10 is provided with a plurality of air nozzles 17. Air is supplied to the nozzles to bubble through water in the bath. To ensure that water does not remain in the nozzles after use of the bath, means 83,85 responsive to the passage of water from the bath is arranged to activate the air supply means 81 after water has left the bath to blow any such water out of the nozzles 17. The responsive means may include a time delay 85 so that the air supply means is not activated until a period after the passage of water from the bath.

11 Claims, 8 Drawing Figures

BATH WITH AIR JET

This invention relates a bath in which streams of air are introduced into the water within the bath to induce turbulence. Baths of this type are subject to the disadvantage that water may enter the air conduits which may be difficult to clean out. British patent application No. 2107180 overcomes this problem by providing each air nozzle with a non-return valve so that air can pass into the bath water, but water cannot enter the air conduit. This solution to the problem has its own disadvantage that the non-return valve increases the resistance to air flow, so that a more powerful pump is required to pump air through the nozzles. Since noise increases with power and noise is not acceptable in a bathroom, extra sound insulation must be provided, or the pump must be placed in a remote location.

It is possible to leave the air conduits open, without a non-return valve, and the water which enters the air conduits when the air flow ceases is then blown out by a short burst of air, as suggested in British Patent Specification No. 2026317. The provision of this short burst of air must be specially actuated by the user of the bath, and may easily become forgotten, leading to lack of hygiene and perhaps eventual blockage in the air conduits.

The present invention provides automatic actuation of the short burst of air once the bath has been emptied after use, according to claim 1 of the claims of this specification.

An example of the present invention will now be described with reference to the accompanying drawings, in which.

Figure 1:
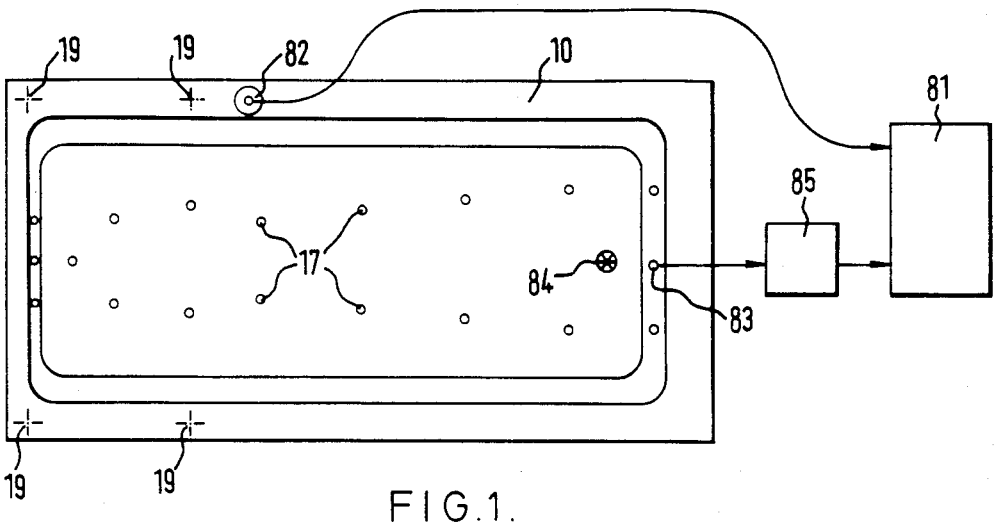
FIG. 1 is a plan view of a bath provided with air jet nozzles.
Figure 2:
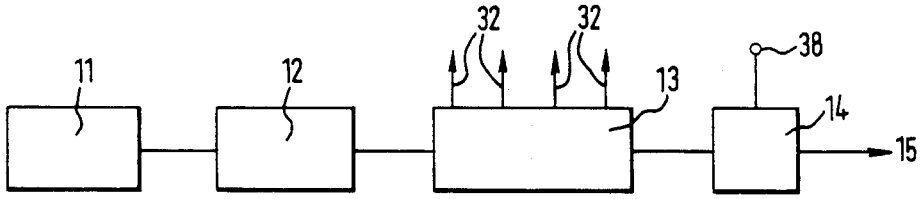
FIG. 2 is a diagram of the air supply to the nozzles.

As illustrated diagrammatically in FIG. 2, air is pumped by a pump 11 past a heater 12 into a manifold 13. A valve 14 controls a low resistance exhaust conduit 15 from the manifold 13. When the valve 14 is closed, air from the manifold 13 passes through a plurality of tubes 32 to air nozzles 17 arranged in the surface of the bath 10 as shown in FIG. 1.

An air blower module 81, powered by an electric induction motor 11, feeds the nozzles 17 through the air manifold 13. The air conduits between the manifold and the nozzles 17 provide free passage for fluid in either direction. A pneumatic on/off button 82, provided for safety reasons, controls the module 81 so that the user of the bath can control the passage of air from the module 81 through the nozzles 17 when he is in the bath. A ceiling pul-switch is a possible alternative to the button 82.

A water sensor 83 is provided in the bath 10 near the bath outlet 84 and is connected through a time delay circuit 85 to the module 81. When the sensor senses water in the bath it resets the circuit 85. When the sensor subsequently senses the absence of water in the bath, it starts operation of the time delay circuit 85 which, after a delay of 10 minutes, activates the module 81 independently of the button 82 for a two minute period so that air is blown through the manifold 13 to the nozzles 17, thus forcing any water therein out of the conduits into the bath so that it can run out of the water outlet 84.

The sensor 83 comprises two electrodes arranged in the bath and means to measure the resistance between the electrodes. This resistance is clearly less when water covers the electrodes than when it does not, so that a simple logic circuit comparing the resistance between the electrodes with a threshold value can be used to actuate the time delay circuit 85. The two electrodes of the sensor 83 may be two of the nozzles 17. It would be possible for the sensor to be mounted in the water outlet, rather than in the bath itself. The power energising the sensor 83 is of very low voltage, such as 0.6 volts, with no direct component (i.e. completely alternating) and the resistance of the path between the electrodes when the bath is full is sufficienty high that the current between the electrodes is at most of the order of microamps and so will not harm the user of the bath.

The motor 11 has been described as an induction motor, and such motors are fairly quiet, although expensive. If a brush motor is used in order to reduce the cost, it may be found to be too noisy when located close to the bath and so must either be arranged at a location remote from the bath, or operated at a voltage below its capacity so as to reduce the noise. In one such example, a 240 volt brush motor is energised from the 240 volt mains through an auto-transformer which reduces the supply voltage by half, the motor operating on 120 volts being much quieter.

The heater 12 is controlled by a micro-switch actuated by means of a hinged flap in the air duct to the pump 11 so that the heater is only switched on when the suction of air from the pump reaches a predetermined level, a fail-safe arrangement. A thermostat (not shown) controls the heater 12 so that the maximum air temperature is 140° C. As the air passes through the manifold 13 and tubes 16 to the nozzles 17, it cools to a temperature of about 55° C.

Figure 3:
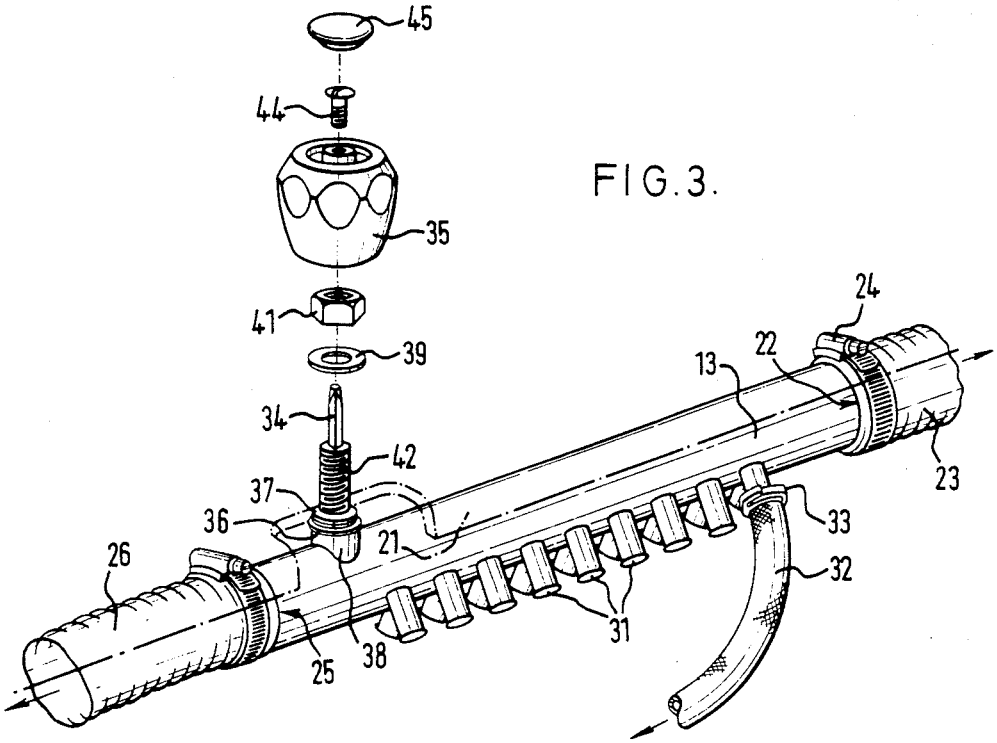
FIG. 3 is an exploded view of the manifold and control valve for the apparatus of FIG. 2.
Figure 4:
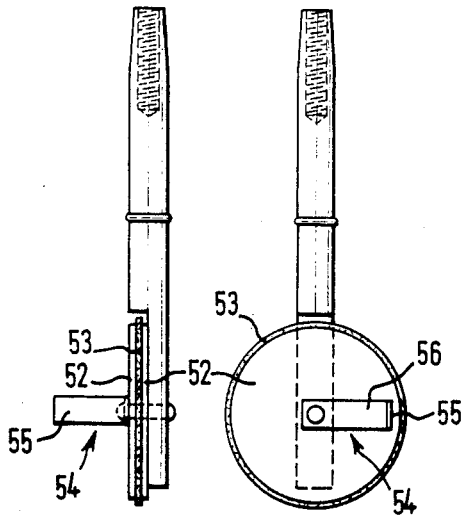
FIG. 4 illustrates the control valve.

As shown in FIG. 3, the manifold 13 is mounted under the lip 21 of the bath and its inlet 22 is connected by means of a flexible hose 23 secured by a hose clip 24 to the conduit from the heater 12. The outlet end 25 of the manifold 13 is connected by a similar hose 26 of 4 cm bore to a vent in the side panel of the bath (see FIG. 7). In the illustrated example, the outlets 31 from the manifold 23 to the nozzles 17 are arranged in two rows of nine outlets each. The outlets 31 are provided with an out-turned lip to assist fixing of the connecting tubes 32 by means of a hose clip 33. Between the outlets 31 and the end 25 of the manifold 13 is a valve having an operating stem 34 passing through the lip 21 of the bath to a handle 35. The exploded view of the valve operating components in FIG. 3 includes steel washer 36 and large rubber washers 37 between the valve body 38 and the underside of the lip 21, a steel washer 39 and a nut 41 engaging a threaded portion 41 of the valve body 38, a tap retaining screw 44 and a tap top cover plate 45. This part of the valve is conventional, but the part of the valve within the manifold 13, as illustrated in FIG. 4 is unconventional. A circular closure member 51 for closing the bore of the manifold 13 comprises a pair of metal discs 52 having sandwiched therebetween a felt disc 53 of slightly larger diameter which will be in sealing engagement with the bore of the manifold 13 when the member 51 is at right angles to the axis of the bore. Rivetted to the centre of the member 51 is an L-shaped member 54 having one arm 55 extending axially of the member 51 and the other arm 56 extending radially of the member to its circumference.

The member 51 can be turned through an angle of less than 90° between its fully closed position in which the end of the arm 56 engages the wall of the manifold 13 to a fully open position in which the end of the arm 55 engages the opposite wall of the manifold 13. With this very small angle of rotation of the handle 35, the air from the heater 12 can be diverted from the conduit 15 to the conduits. When the valve 14 is open the air pressure in the manifold is much reduced and very little air will be forced through the nozzles, particularly those at some depth below the water surface.

Figure 5:
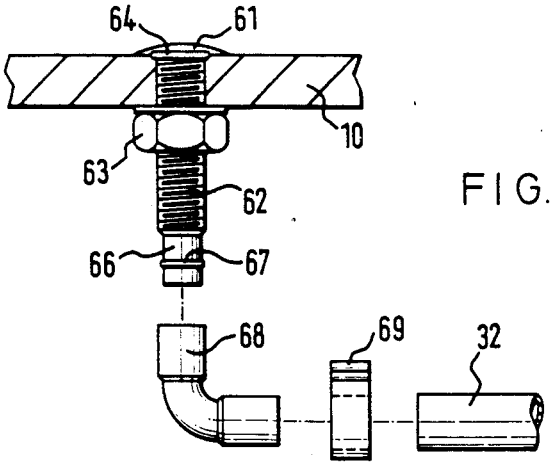
FIG. 5 illustrates the air jet nozzle and its connections.
Figure 6:
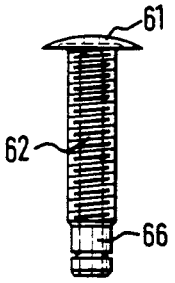
FIG. 6 illustrates the construction of the air jet nozzle.

FIGS. 5 and 6 show the simplicity of construction of the nozzles 17 and their connection to the hoses 32. The nozzle 17 has a shallow domed head 61 and an externally threaded portion 62 engaged by a nut 63 to fix the nozzle body 17 to the bath 10. An O-ring seal 64 seals the head 61 to the bath surface 10, and a washer 65 is placed between the nut 63 and the bath 10. Below the threaded portion 62 the nozzle 17 has a stem 66 provided with an O-ring seal 67 in a groove. The nozzle 17 is secured to the hose 32 by means of a copper elbow 68 which has a very slightly tapered bore which engages the stem 66. A nylon hose clip 69 secures the hose 32 to the other end of the elbow 68. This simplicity of assembly is very useful when nozzles 17 are being fixed to baths already in situ, once the nozzles 17 have been secured to the bath by means of the nut 63, the elbow 68 is a push-fit on the stem 66 and the hose 32 placed on the elbow 68 is simply secured by the hose clip 69.

Figure 7:
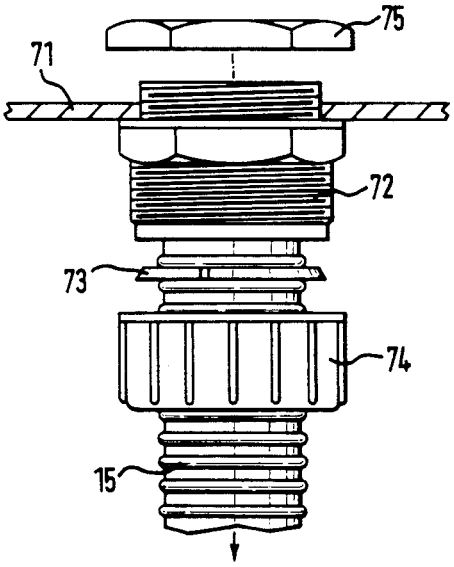
FIG. 7 illustrates the connection of the exhaust conduit to the bath panel.

FIG. 7 illustrates the connection of the exhaust conduit 15 to the decorative side panel 71 of the bath. The conduit 15 is in the form of a flexible hose which is secured to a vent body 72 by means of a clip 73 and a clamp 74 screwed onto the vent body 7. The body 72 is secured by means of the nut 75 to the panel 71.

The arrangement of nozzles 17 shown in FIG. 1 have been found to be particularly suitable, but the arrangement can be varied as required. The nozzles shown at the ends of the bath can be mounted above the base of the bath but below the normal height of water in the bath, for example up to 12 cm. Possible positions for the valve handle 35 are shown at 19 in FIG. 1.

Figure 8:
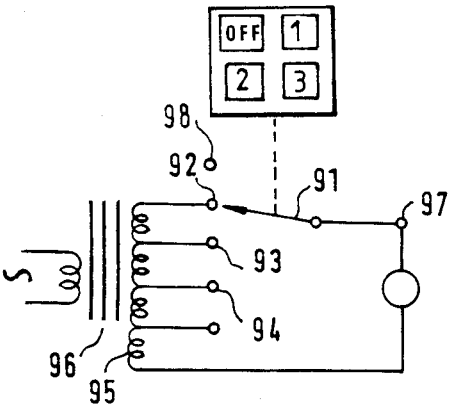
FIG. 8 illustrates a speed control device for the pump motor.

In an alternative embodiment, the outlet end 25 of the manifold 13 shown in FIG. 3 is blocked, so that there is no hose 26 or a vent in the side panel of the bath. Similarly, there is no valve 14. Instead, the motor is provided with an electric controller so that when it is desired to blow air through the nozzles, the motor is operated at a speed sufficient to overcome the resistance of the water in the bath over the nozzles. The controller may be adjustable to drive the motor at different speeds, for different rates of blowing air through the nozzles. The speed controller may connect different secondary windings of a transformer to the motor so as to apply different voltages to the motor to cause it to operate at different speeds. The controller may be in the form of touch sensitive electric switches and must be designed so that there is no danger of electrocution of the user. A typical speed controller is illustrated in FIG. 8, including a switch 91 connected to different taps 92, 93, 94 of the secondary winding 95 of a transformer 96 to a power input terminal 97 of an electric pump motor. By switching between different taps 92, 93, 94 and a position 98 in which the motor is disconnected from the secondary winding, the speed of the motor can be controlled between zero through intermediate speeds to a maximum.

I claim:

1. Aereation equipment for a bath comprising a plurality of nozzles which can be arranged to project through the base of the bath, means for supplying air to said nozzles and means responsive to the passage of water out of the bath to actuate the air supplying means.

2. Equipment as claimed in claim 1 comprising actuating means for operation by the user of the bath to actuate the air supplying means, said responsive means operating independently of the actuating means.

3. Equipment as claimed in 1 wherein said responsive means comprises a sensor responsive to the resistance between two electrodes located in a volume occupied by water when in or leaving the bath.

4. Equipment as claimed in claim 3, wherein said electrodes comprise two of said nozzles.

5. Equipment as claimed in claim 1, wherein said responsive means comprises a time delay operative to actuate the air supplying means starting a period after the passage of water from the bath.

6. Equipment as claimed in claim 1, comprising an outlet to the atmosphere for said air supplying means independent of said nozzles and means to control the passage of air through a conduit leading to said outlet.

7. Equipment as claimed in claim 6, wherein said control means comprises a pair of rigid plates having sandwiched therebetween a sealing number extending beyond the periphery of the plates for sealing against the wall of said conduit, the plate being movable to a position in which they allow air to pass to said outlet.

8. Equipment as claimed in claim 1, wherein said nozzle comprises a body having a stem provided with a circumferential seal and a connecting member which is a push-fit on the stem to engage said seal.

9. Eeuipment as claimed in claim 8, wherein said connecting member provides a right-angles passage fo air.

10. Equipment as claimed in claim 1, wherein said air supplying means comprises an air pump and electrical control means for controlling the speed of operation of the pump.

11. A bath provided with aereation equipment as claimed in claim 1 and an outlet conduit through which water can leave the bath after use, said nozzles being arranged in the base of the bath and the responsive means comprising a sensor arranged in said outlet conduit.

* * * * *